United States Patent [19]

Johnson

[11] 4,455,271

[45] Jun. 19, 1984

[54] FOAMED GYPSUM WALLBOARD

[75] Inventor: Robert M. Johnson, Kenmore, N.Y.

[73] Assignee: National Gypsum Company, Dallas, Tex.

[21] Appl. No.: 462,755

[22] Filed: Feb. 1, 1983

Related U.S. Application Data

[63] Continuation of Ser. No. 303,265, Sep. 17, 1981, abandoned.

[51] Int. Cl.[3] ..... B32B 5/20

[52] U.S. Cl. ..... 264/42; 264/50; 264/333

[58] Field of Search ..... 264/42, 50, 109, 112, 264/333

[56] References Cited

U.S. PATENT DOCUMENTS

| | | | |
|---|---|---|---|
| 2,079,565 | 5/1937 | Roos et al. | 83/73 |
| 2,639,901 | 5/1953 | Teale | 259/8 |
| 2,864,714 | 12/1958 | Dixon et al. | 106/88 |
| 3,974,024 | 8/1976 | Yano et al. | 162/101 |
| 4,057,443 | 11/1977 | Stiling | 264/50 |
| 4,057,608 | 11/1977 | Hashimoto | 264/42 |

*Primary Examiner*—John Parrish

*Attorney, Agent, or Firm*—Robert F. Hause

[57] ABSTRACT

Lightweight gypsum wallboard produced by continuously combining a small amount of surface active agent with a liquid stream, which stream is made up of substantially all of the water to be used in the manufacture of a continuous web of gypsum wallboard, passing this mixture through a long cylindrical static mixing tube filled with one inch ceramic saddles, while adding a controlled quantity of air thereto, then passing the mixture through a shorter cylindrical static mixing tube of equal diameter filled with ⅜ inch ceramic Raschig rings, forming a uniformly dispersed foam of very small bubbles from the liquid by completely generating all of the surface active agent therein to form this foam, and mixing this foamed liquid with finely ground dry calcined gypsum in a suitable mixing device to form a foamed settable gypsum slurry, disposing the slurry between paper cover sheets, and forming a continuous web of gypsum wallboard.

8 Claims, 1 Drawing Figure

FOAMED GYPSUM WALLBOARD

Figure 1:
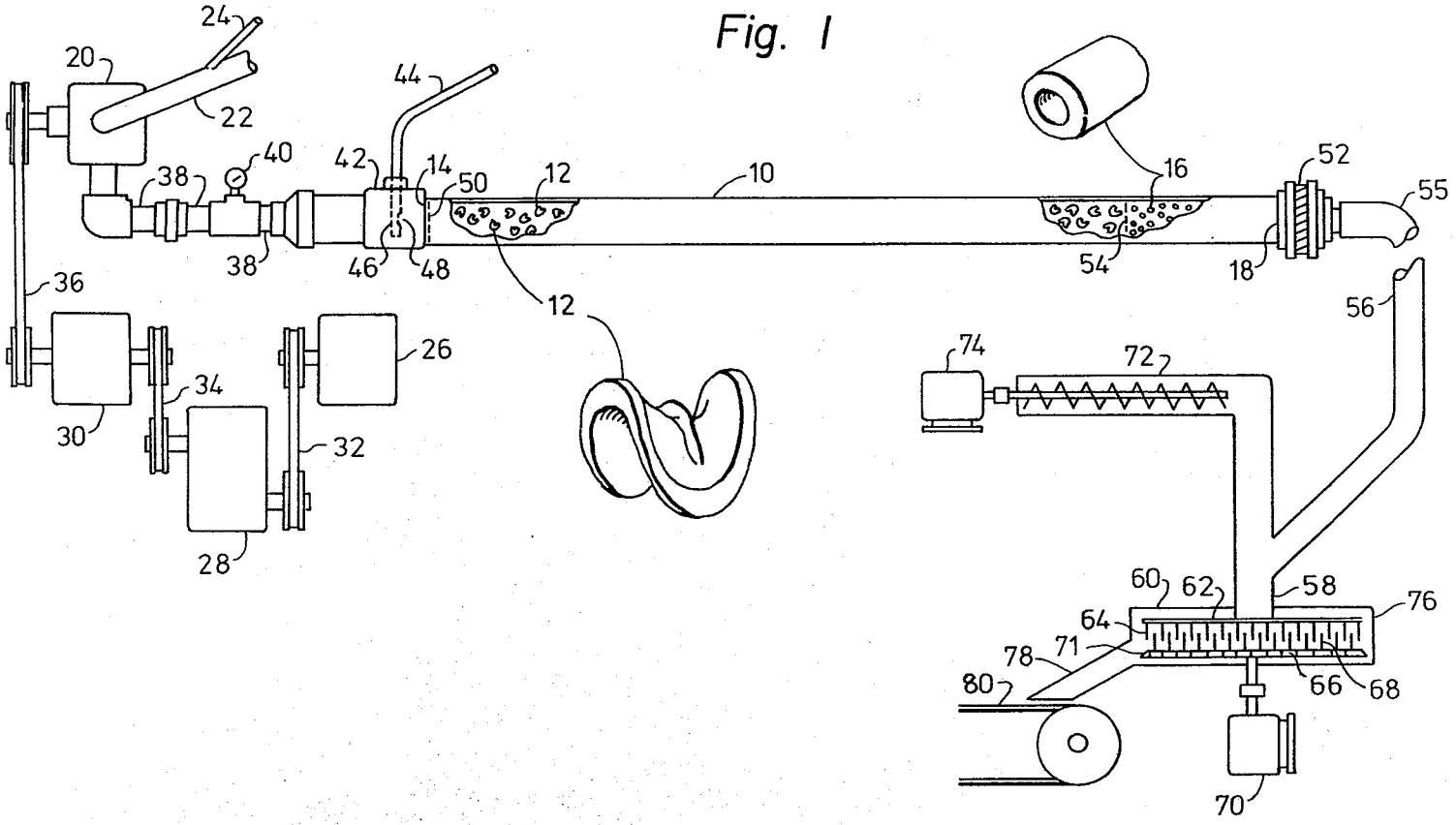

This is a continuation of application Ser. No. 303,265, filed Sept. 17, 1981 now abandoned.

This invention relates to an improvement in the process of making gypsum wallboard, and particularly to the steps of forming a fine, thoroughly dispersed foam within the gypsum core, to reduce the weight of the wallboard.

The methods and apparatus involved in forming foam for inclusion in the gypsum wallboard core, prior to the invention of U.S. Pat. No. 4,057,443, had not changed substantially for fifty years from that disclosed in U.S. Pat. No. 2,079,565. This should not be construed to mean that elements of the U.S. Pat. No. 2,079,565, other than those related to forming the foam in the foam generator cells, have been in practice up until the present invention. To the contrary, the method of adding the generated foam to the calcined gypsum has most commonly been carried out in pin mixers, having intermeshed opposed pins, such as in U.S. Pat. No. 2,639,901.

The present invention, like the invention of U.S. Pat. No. 4,057,443, contemplates passing a major portion of all the liquids to be used in the gypsum core, if not all of the liquid, through the foam generator, with the surface active agent and air, and provides a foam generator structure capable of great agitation even under the load caused by inclusion of substantially all the liquids during this agitation.

The foam generator of the present invention is an elongate cylindrical static mixer. U.S. Pat. No. 2,864,714 discloses an elongate conical static mixer for preparing very low density foam for addition to prewetted and premixed cementitious materials such as Portland cement, gypsum, clay and other powdered materials which solidify after having been made plastic with water. Although it is not essential in the present invention that the calcined gypsum be completely dry when the preformed foam is added to it, it is essential that a major portion of the water to be used in the wallboard gypsum core be passed through the cylindrical mixer whereat the foam is formed.

It is an object of the present invention to provide a novel low cost apparatus for forming foam, for gypsum wallboard, having low energy requirements, providing very complete generation of large quantities of foam water.

It is a further object of the invention to provide apparatus for foaming substantially all of the water for gypsum wallboard production using less than 20% of the horsepower of the closest prior apparatus intended for this particular use.

It is a further object to provide an improved method for preparing and adding preformed foam to a mixer for gypsum wallboard core ingredients.

These and other objects and advantages will be more fully apparent when considered in relation to the preferred embodiments thereof as set forth in the specification and as shown in the drawings in which:

FIG. 1 is a diagrammatic flow chart of the process and apparatus of the invention, portions being broken away, and associated drive means.

Referring to the drawing there is shown a static mixer tube 10. Tube 10 is a six foot long, four inch diameter, polyvinyl chloride tube, which is packed full with static fill consisting of randomly arranged one inch Berl ceramic saddles 12, in a five foot portion adjacent the inlet 14, and of ⅜ inch O.D., 3/16 inch I.D., ⅜ inch long ceramic Raschig rings 16 in a one foot portion adjacent the outlet 18.

Water, soap solution and air are fed into tube 10 through inlet 14. The water is fed first to a positive displacement type water pump 20, such as a Viking water pump, through pipe 22. Soap solution is fed into pipe 22 through smaller pipe 24.

Water pump 20 is driven by a motor 26 through a speed regulator 28 and a speed reducer 30 with belt drives 32 and 34. Speed reducer 30 then drives pump 20 by a chain drive 36.

Water and soap solution is pumped accurately and positively by pump 20 through pipes 38 having a fluid pressure gauge 40 thereon to measure back pressure. At a tee 42 adjacent inlet 14, a ½ inch air pressure hose 44 supplies air under pressure to join with the water and soap solution entering tube 10. Regulators and gauges in the air supply are not shown. Inside the tee 42, a short length of pipe 46, having an orifice 48 of about 0.209 inch diameter, directs the air from hose 44 into the inlet 14 of static mixer tube 10.

Three ¼ inch mesh stainless steel screens 50, 52 and 54 are located respectively at inlet 14, at outlet 18 and are five feet from the inlet between the ceramic saddles 12 and the ceramic Rashig rings 16. Performed foam flowing through outlet 18 then flows through a hose 55, tube 56 and then through a mixer inlet 58 to a gypsum slurry mixer 60 whereat the foamed water is mixed with calcined gypsum and all other ingredients that may be desired in a gypsum wallboard core.

The constant feeding of water, soap solution and air through inlet 14 continually creates an aerated fluid with bubbles apparently about ¼ inch in diameter. As the aerated liquid is forced through the portion of tube 10 containing ceramic saddles 12, the water and soap solution is very thoroughly homogenized, with air bubbles in it becoming somewhat reduced in size. As this homogenized liquid with air bubbles in it is forced through the portion of tube 10 containing Raschig rings 16, the air bubbles are subdivided into substantially the finest form that can be obtained for any given type of soap solution and any given ratio of soap to water.

The amount of water and soap solution passing through tube 10 per unit of time will depend on the weight of the wallboard being produced per unit area and the rate at which the unit area is being produced. As a typical example, the invention may be used in producing lightweight gypsum wallboard ½ inch thick, of a weight of 1650 lbs per thousand square feet. The gypsum core weight will typically be 1530 lbs per MSF, the balance of the weight being the two paper cover liners.

This 1650 lb wallboard can be produced at varying rates. Assuming a rate of a thousand square feet every 2½ minutes, there is approximately 660 lbs per minute or 610 lbs of gypsum core per minute. Assuming a 90% purity of the calcined gypsum being used to produce this gypsum core, there is required about 216 lbs per MSF, or 86 lbs per minute, of water to chemically combine with the calcined gypsum to produce set gypsum, and about 860 lbs per MSF, or 344 lbs per minute, of additional water for proper fluidity to form the wallboard, which additional water must be removed in the dryer.

This makes a total of 430 lbs of water per minute required in producing the ½ inch gypsum wallboard of 1650 lbs per MSF total weight. This 430 lbs of water per minute can be supplied to the core slurry mixer 60 by supplying about 344 lbs per minute from the static tube 10, as foamed water, and about 86 lbs of water per minute in the form of paper pulp aqueous slurry. Heated water, up to a maximum of about 120° F, is advantageous, but not essential.

The amount of paper pulp used in the pulp slurry is preferably about 2 lbs per minute, and may be varied considerably or even eliminated in accordance with the invention. The amount of surface active agent used per minute, is about 0.3 lb per minute, and may be varied from about 0.1–1.0 lb per minute.

The surface active agent can be any of the known class of chemicals used to form a foam, such as soaps or foaming agents, and, as an example that can be used, there is the sodium salt of sulfated ethoxylated alcohol, sold by Onyx Chemical Company, as a 55% solution in water, under the trademark MILLI-FOAM.

Other ingredients of the wallboard core that will commonly be added to the pulp slurry will include about 2 lbs of set accelerator per minute, about ½ lb of a water-reducing agent, and about 2 lbs of starch. The set accelerator may be freshly ground gypsum or potassium sulfate or a combination thereof. The water-reducing agent may be any of a number of solid or aqueous solution forms of calcium or sodium lignosulfonates, or mixtures thereof. The pulp slurry is prepared separately from the foam generator and is directed to the pin mixer through tube 56.

The calculated volume of air desired in the 1650 lb wallboard is 13.3 cubic feet per MSF, or approximately 5.3 cubic feet per minute, as the wallboard is being formed. Actual input of air into tube 10 will have to take into account the efficiency of the foam or the amount of breakdown of foam in the process between generating the foam and forming the wallboard.

The discharge portion of the tube 10 includes outlet 18 and a flexible 2½ inch I.D. hose 55. Hose 55 directs the foamed liquid from the tube 10 to tube 56 where it mixes with the pulp slurry in tube 56 and continues to inlet 58 of a pin mixer 60, shown diagrammatically with a fixed upper plate 62 with downwardly projecting pins 64 and a bottom rotary plate 66 with upwardly projecting intermeshing pins 68. Bottom plate 66 is affixed to a suitable drive motor 70, and has a saw-toothed edge 71.

The finely ground gypsum is fed to a feeder 72 driven by motor 74. Feeder 72 permits controlled feeding of the gypsum powder to the pin mixer inlet 58. Pin mixer 60 is shown with a single central top inlet for all ingredients, however the pin mixer can have separate inlets and the inlets do not need to be located at the center but must be located inwardly of the outer periphery 76 of the pin mixer. The rotary action of the bottom plate urges the materials to move radially outward, and subjects the material to a mixing action produced by the intermeshing pins and/or the saw-toothed edge 71 formed on bottom plate 66.

The pin mixer has one or more outlets 78 through which the mixed calcined gypsum and liquids flow, to reach wallboard producing equipment 80.

In the above preferred embodiment of the invention, about 80% of the water for the gypsum core is subjected to the turbulence, and made into foam, in the static mixer tube 10. If paper pulp is not desired in a particular wallboard core formulation, all of the water would preferably be made into foam in tube 10.

As a second example of suitable dimensions for tube 10, the portion adjacent the outlet 18 contains the relatively larger, substantially uniform sized wear resistant water flow diverting elements, such as one inch saddles 12, and is a three foot section of six inch diameter. The portion adjacent inlet 14 contains relatively smaller, substantially uniform sized wear resistant water flow diverting elements, such as ½ inch O.D., ¼ inch I.D. and 11/16 inch long Raschig rings, and is a three foot section of four inch diameter.

In both examples, the foam produced is delivered out of outlet 18 at a relatively fast rate of flow, preferably at a density of from about 10 to 20 pounds per cubic foot.

Those familiar to the art of wallboard manufacture recognize that generating foam of substantial volume requires a high amount of energy. For example, most churn type generators similar to that in U.S. Pat. No. 4,057,443 require a 30 to 50 HP motor to effectively generate 430 lbs of foam water per minute into a quality foam. This invention requires a 5 or 7½ HP motor to produce an equal or higher quality foam. As will be seen in the drawing, the mixer tube 10 is completely free of any power-consuming agitating mechanism.

Having completed a detailed disclosure of preferred embodiments of my invention so that those skilled in the art may practice the same, I contemplate that variations may be made without departing from the essence of the invention.

I claim:

1. The continuous method of making lightweight gypsum wallboard in which a stable foam is continuously produced by forming air bubbles in an aqueous solution of a surface active agent, comprising the steps of continuously admixing a surface active agent with a major portion of the water to be used in forming said gypsum wallboard, continuously adding air to said mixture, subjecting the said mixture to a turbulent flow agitation by moving said surface active agent, said water and said air through a tubular chamber, which is free of any power-consuming agitating mechanisms, but which is substantially filled with static fill consisting of substantially uniform size, wear resistant water flow diverting elements causing the air in said mixture to become finely subdivided by its being passed around said flow diverting elements, and subsequently admixing finely ground calcined gypsum with the stable foamed liquid product of said agitation, and forming said gypsum and foamed liquid mixture into lightweight foamed core gypsum wallboard.

2. The method of claim 1 wherein substantially all of the water used in making gypsum is subjected to said turbulent flow agitation.

3. The method of claim 1 wherein said stable foamed liquid product of said agitation has a density of from about 10 to 20 pounds per cubic foot.

4. The method of claim 3 wherein said foam forming requires about 5 horsepower to produce over 400 pounds and up to 800 pounds of fine foamed water per minute.

5. The method of claim 1 wherein substantially all of the water used in forming said wallboard is foamed in said tubular chamber.

6. Apparatus for making gypsum wallboard comprising means for supplying liquid ingredients of said gypsum wallboard, means for supplying finely ground calcined gypsum, means for mixing said liquid ingredients and said calcined gypsum, means for combining a surface active agent and air with a major portion of said supply of liquid and means for subjecting said combination of surface active agent, air and liquid to an agitation consisting of turbulent flow prior to being mixed with said calcined gypsum, said means for agitation comprising a tubular chamber which has a substantially constant diameter throughout portions of its length and being substantially filled with substantially uniform sized wear resistant, water flow diverting elements.

7. Apparatus as defined in claim 6, wherein said tubular chamber has a diameter of about four to six inches.

8. Apparatus as defined in claim 6, wherein said tubular chamber has an outlet tube connected to a gypsum slurry pin mixer.

* * * * *

UNITED STATES PATENT AND TRADEMARK OFFICE

CERTIFICATE OF CORRECTION

PATENT NO. : 4,455,271

DATED : June 19, 1984

INVENTOR(S) : ROBERT M. JOHNSON

It is certified that error appears in the above-identified patent and that said Letters Patent are hereby corrected as shown below:

Column 4, lines 37 and 38, "a tubular chamber, which is free of any power-consuming agitating mechanisms, but" should have read ---a static mixer tube---.

Claims 6-8 should have been deleted.

On the title page, "8 Claims" should read -- 6 Claims --.

Signed and Sealed this

*Twenty-third* Day of *October 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,455,271

DATED : June 19, 1984

INVENTOR(S) : ROBERT M. JOHNSON

It is certified that error appears in the above-identified patent and that said Letters Patent is hereby corrected as shown below:

Column 4, lines 37 and 38, "a tubular chamber, which is free of any power-consuming agitating mechanisms, but" should have read ---a static mixer tube---.

Claims 6-8 should have been deleted.
On the title page, "8 Claims" should read -- 5 Claims --.

This certificate supersedes certificate of correction issued October 23, 1984.

Signed and Sealed this

*Twenty-second* Day of *October 1985*

[SEAL]

*Attest:*

DONALD J. QUIGG

*Attesting Officer*

*Commissioner of Patents and Trademarks—Designate*